United States Patent [19]

Cooksey et al.

[11] Patent Number: 4,474,112

[45] Date of Patent: Oct. 2, 1984

[54] ARMING FIRING RELOCK DEVICE

[75] Inventors: George E. Cooksey, Lake Isabella, Calif.; John F. Prescott, Norfolk, Va.; Rodney H. Zagala, Ridgecrest, Calif.

[73] Assignee: The United States of America as represented by the Secretary of the Navy, Washington, D.C.

[21] Appl. No.: 471,576

[22] Filed: Mar. 3, 1983

[51] Int. Cl.[3] ..... F42C 15/24; F42C 15/40

[52] U.S. Cl. ..... 102/260; 60/39.821; 60/39.091; 102/254; 102/262

[58] Field of Search ..... 102/260, 262, 254, 258; 60/39.823, 39.821, 39.091

[56] References Cited

U.S. PATENT DOCUMENTS

| | | | |
|---|---|---|---|
| 2,201,209 | 5/1940 | Schultze | 102/254 |
| 2,913,984 | 11/1959 | Meek et al. | 102/262 X |
| 2,954,733 | 10/1960 | Samburoff et al. | 102/254 |
| 2,958,283 | 11/1960 | Caldwell et al. | 102/254 |
| 3,052,784 | 9/1962 | Ousley | 102/262 X |
| 3,111,810 | 11/1963 | Branman et al. | 60/39.823 X |
| 3,311,058 | 3/1967 | Fohrmann et al. | 102/262 X |
| 3,423,931 | 1/1969 | Schwarz et al. | 60/39.821 X |
| 3,515,071 | 6/1970 | Brackman | 102/222 X |
| 3,529,418 | 9/1970 | Puckett et al. | 60/39.09 |
| 3,618,522 | 11/1971 | Henderson | 102/254 X |
| 3,636,878 | 1/1972 | Fay | 102/262 X |
| 4,202,271 | 5/1980 | Day | 102/262 X |

*Primary Examiner*—David H. Brown

*Attorney, Agent, or Firm*—Robert F. Beers; W. Thom Skeer; Thomas W. Hennen

[57] ABSTRACT

An arming firing relock device includes a resiliently biased handle lock, a drive shaft, an output shaft or keyed member and a pivot block which may be attached to the exterior surface of a rocket motor. The output shaft may be connected to drive a rocket motor arming firing device. The handle lock moves between a safe position and an armed position via a free position in which the handle lock, drive shaft and output shaft or keyed member may be rotated to control the arming firing device. The pivot block, output shaft or keyed member, drive shaft and handle lock all cooperate to positively lock the arming firing device in the safe or the armed positions respectively, yet enable changing positions without the need for tools.

20 Claims, 5 Drawing Figures

Fig. 1
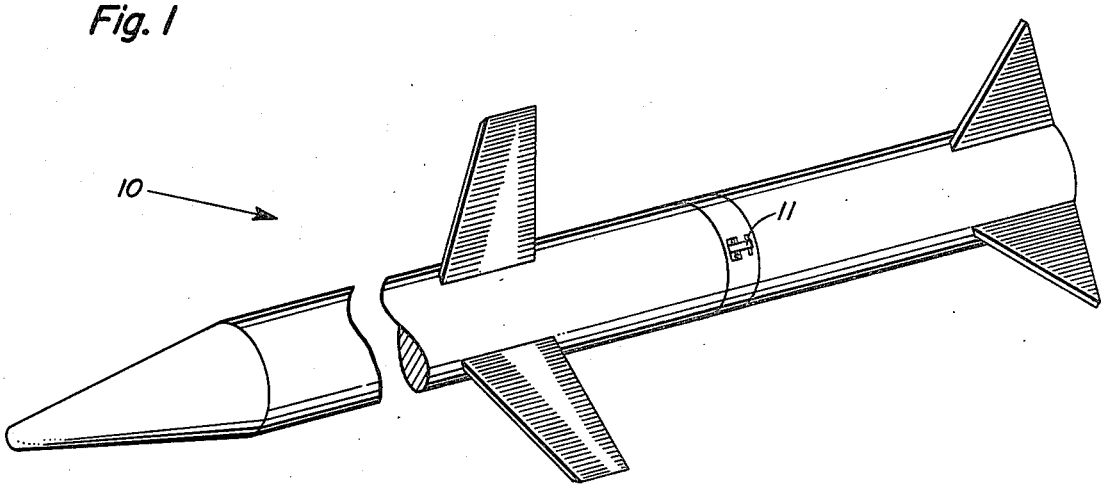
Fig. 2
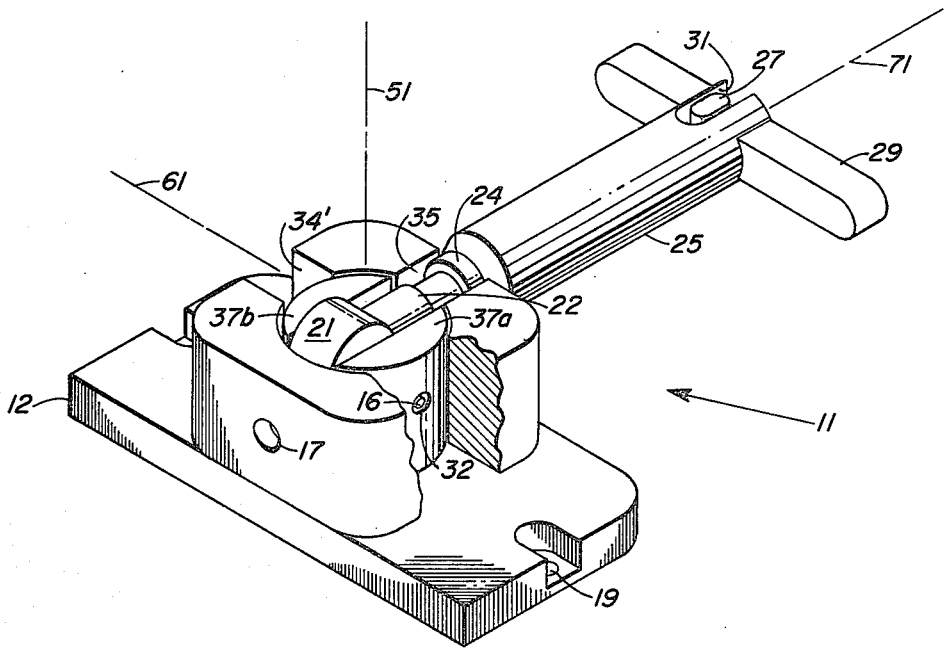
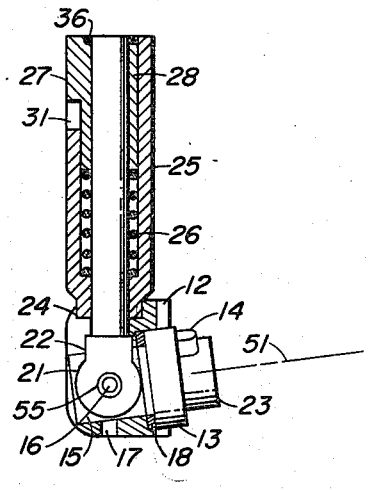
Fig. 3

ARMING FIRING RELOCK DEVICE

BACKGROUND OF THE INVENTION

1. Field of the Invention

This invention pertains to rocket powered missiles, and more particularly it pertains to rocket motors having arming firing devices for preventing accidental premature ignition of the rocket motor. Most particularly, this invention pertains to mechanical devices for manually controlling the arming firing device from outside the missile structure and without the use of tools.

2. Description of the Prior Art

Rocket motors such as those used in guided missiles commonly employ an arming firing device which when in the safe position vents the combustion products of an electrically initiated squib device to the exterior of the missile to protect against premature accidental ignition of the rocket motor in the event the squib accidently fires. When in the armed position, the arming firing device directs the products of combustion of the electrically initiated squib to a booster charge which in turn ignites solid propellant fuel in the rocket motor. Prior designs have utilized an input drive shaft which extends from the exterior surface of the missile to the arming firing device which is located deep within missile structure at the forward end of the rocket motor section. This input shaft includes a key socket positioned at the outer surface of the guided missile structure. An operator uses a key to engage the key socket and move the arming firing device from the safe position to the armed position just prior to launch of an aircraft carrying the missile. The key is normally installed and retained in the key socket while the arming firing device is in the safe position. This design requires the operator to rotate and remove the key to arm the rocket motor just prior to launch of the aircraft carrying the missile and presents the possibility that a loose key may be dropped to the flight deck and ingested by the jet engine of a subsequent aircraft, resulting in severe engine damage. Further, it has been found in some cases that an armed position detent mechanism fails to positively engage and vibration may cause the arming firing device to return from the armed position to the safe position prior to missile launch from a carrying aircraft, resulting in a failure of the rocket motor to fire on command.

SUMMARY OF THE INVENTION

These limitations and disadvantages of the prior art have been overcome in the present invention which provides positive locking in either the safe or armed positions respectively, without the use of tools or other removable parts.

Accordingly, it is an object of the present invention to provide positive locking of the arming firing device in the safe position to prevent accidental arming and possible premature firing of the rocket motor.

Another object of the present invention is to provide positive locking in the armed position to prevent inadvertant safing and resultant rocket motor failure to ignite.

Still another object of the present invention is to provide manual control of the arming firing device without the use of tools.

Still another object of the present invention is to provide manual control of the arming firing device without removing any parts from the device.

Another object of the present invention is to provide a positive indication of arming firing device position.

BRIEF DESCRIPTION OF THE DRAWING

Other objects, advantages and novel features of the invention will become apparent from the following detailed description of the invention when considered in conjunction with the accompanying drawing figures, wherein:

FIG. 1 illustrates the arming firing relock device of the present invention installed on a guided missile;

FIG. 2 illustrates a perspective view of an arming firing relock device according to the present invention;

FIG. 3 illustrates a sectional view of an arming firing relock device according to the present invention;

DESCRIPTION OF THE PREFERRED EMBODIMENT

Figure 4:
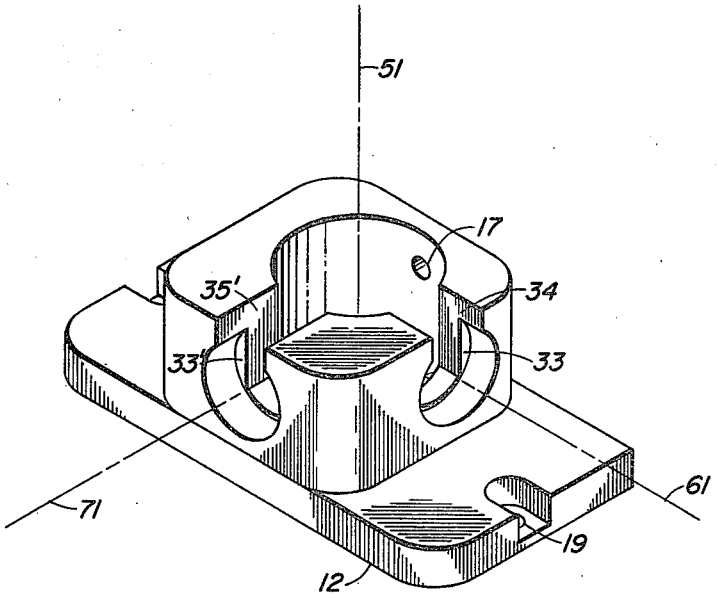
FIG. 4 illustrates a perspective view of the pivot block in the present invention.

Referring to the drawing figures wherein like parts and elements are identified by like reference characters throughout the several views there is shown in FIG. 1 a guided missile 10 having an arming firing relock device 11 installed. Arming firing relock device 11 is shown in the armed position.

Referring now to FIGS. 2 and 3, arming firing relock device 11 is shown to include pivot block 12 which has fastener holes 19 for use in attaching pivot block 12 to exterior missile structure. Mounted in pivot block 12 for rotation about output shaft axis 51 is keyed member 13. Thrust washer 18 separates keyed member 13 from pivot block 12 and provides a bearing surface. Central pilot 23 is configured to engage a key socket which is part of preexisting missile structure and which is used to control the position of the missile arming firing device. Key lug 14 engages a portion of the key socket and enables keyed member 13 to transmit torque through the key socket to the arming firing device. Driven end 15 of keyed member 13 includes a longitudinal slot which divides driven end 15 into two parallel symmetrical semicircular cylinders 37*a* and 37*b*. Semicircular cylinder 37*a* has pivot hole 32 which extends coaxially to form a pivot hole in semicircular cylinder 37*b* also. Driven end 15 of keyed member 13 is identical to driven end 15' of alternative output shaft 13' shown in FIG. 5. There, semicircular cylinders 37*a'*, 37' and pivot hole 32' correspond to identical structure on keyed member 13.

Drive shaft 21 is positioned within the central transverse slot of driven end 15 and is pivotably attached to semicircular cylinders 37*a* and 37*b* by means of spring pin 16 which is dimensioned to fit tightly within drive shaft pivot hole 55 and to pivot freely on each end within pivot hole 32 in semicircular cylinders 37*a* and 37*b*. Drive shaft 21 has a toroidal end concentric with spring pin 16 which provides maximum material strength in this area without interfering with keyed member 13 or output shaft 13' as drive shaft 21 pivots on spring pin 16.

Access hole 17 is positioned within pivot block 12 to be coaxial with pivot hole 32 when keyed member 13 is rotated to the safe position. This enables spring pin 16 to be removed in the event disassembly of arming firing relock device 11 becomes necessary. Access hole 17 may also be used to permit a remove-before-launch indicator to be passed through the center of spring pin 16 as an additional visual indication that the missile arming firing device is in the safe position and must be armed prior to launch of an aircraft carrying the missile.

Drive shaft 21 has limiting shoulder 22 which serves to bear against locking shoulder 24 on handle lock 25 when the arming firing relock device is in an intermediate position between the safe position and the armed position as more clearly described in the operational portion of this description. Encircling drive shaft 21 and contained within handle lock 25 is helical compression spring 26. Spring stop 28 is rigidly attached to drive shaft 21 by any convenient means. Spring stop 28, for example, could be welded to drive shaft 21 at interface 36. Spring stop 28 bears against helical compression spring 26 on one end. This maintains the other end of helical compression spring 26 in contact with handle lock 25, thereby urging handle lock 25 toward limiting shoulder 22. Spring stop 28 has spline 27 which is aligned with longitudinal slot 31 to enable handle lock 25 to move longitudinally along drive shaft 21 without interferring with spring stop 28 and yet enabling the transmission of torque from handle lock 25 to drive shaft 21 by means of interaction between the sides of longitudinal slot 31 and spline 27. Handle lock 25 includes opposed lateral projections 29 which are used by an operator to grip handle lock 25, to slide it along drive shaft 21 against the force of helical compression spring 26 and to rotate drive shaft 21 to thereby operate the device.

Referring to FIG. 2 and FIG. 4, pivot block 12 is illustrated having safe locking shoulder socket 33 (safe engagement socket) for receiving locking shoulder 24 to define the safe position, and armed locking shoulder socket 33' (armed engagement socket) for receiving locking shoulder 24 to define the armed position. Thus, locking shoulder 24 constitutes means for lockingly engaging pivot block 12 in safe and armed positions, and sockets 33 and 33' constitute means for receiving a member. Further, pivot block 12 is configured to include safe indexing walls 34 and 34' for engaging drive shaft 21 and thereby prevent rotation of output shaft 13 about output axis 51. Similarly, pivot block 12 includes armed indexing walls 35 and 35' which engage drive shaft 21 and thereby prevent rotation of keyed member 13 for alternative output shaft 13' about output axis 51.

Figure 5:
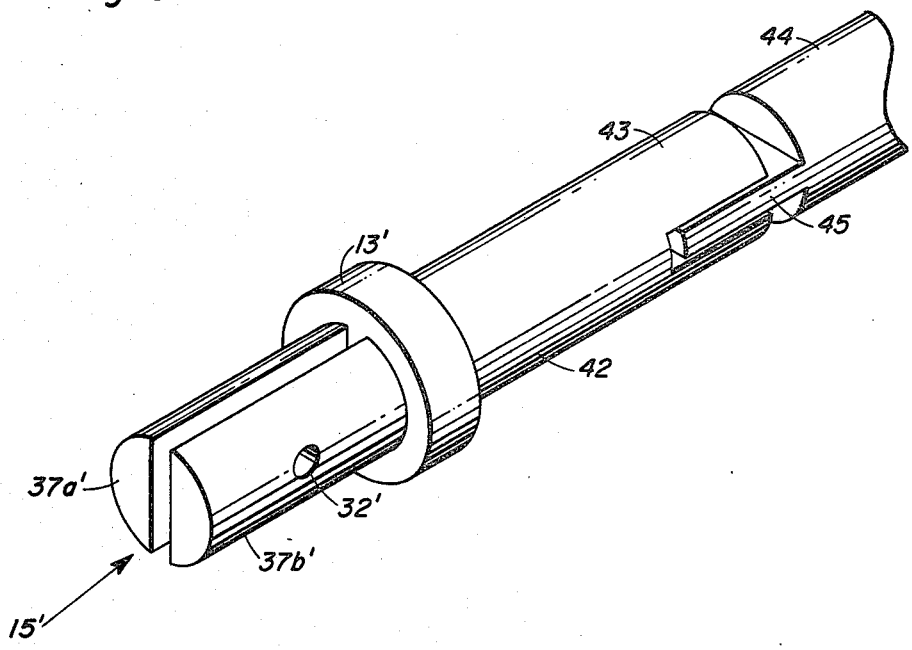
FIG. 5 illustrates an alternative output shaft.

Referring now to FIG. 5, alternative output shaft 13' is shown having extended coupling shaft 42 which includes bifurcated end 43. Alternative output shaft 13' may be used in arming firing relock device 11 when the key socket type arming firing device control is not used. In this case, extended coupling shaft 42 extends into the missile structure and bifurcated end 43 engages tang 45 on arming firing device input shaft 44. In this case, where no key socket is used, there is no need for thrust washer 18. Normally, the key socket is spring loaded and employs a detent type mechanism to lock in the armed position, and must be depressed to release the detent when moving from the armed position to the safe position. This fact requires output shaft 13 to be forced into contact with the key socket against spring pressure to maintain the detent in the permanently unlocked position since the arming firing relock device includes its own position locks. Of course, when the key socket is not used on the missile structure, no requirement exists to apply axial force on output shaft 13' to overcome this detent spring pressure, and therefore no thrust load occurs.

OPERATION

Referring to FIG. 2 and FIG. 4, handle lock 25 is shown aligned with armed position axis 71, thereby defining the armed position. In order to change arming firing relock device 11 to the safe position, an operator grasps opposed lateral projections 29 and applies a force away from pivot block 12. This causes helical compression spring 26 to compress and locking shoulder 24 to be withdrawn from armed locking shoulder socket 33', thereby enabling drive shaft 21 to be pivoted about spring pin 16 until handle lock 25 is approximately aligned with output axis 51. In this position, drive shaft 21 is no longer retained between armed indexing walls 35 and 35', so that torque manually applied to handle lock 25 is transmitted to drive shaft 21 and causes keyed member 13 or alternative output shaft 13' to rotate about output axis 51. In this position, releasing pressure on opposed lateral projections 29 allows locking shoulder 24 to come in contact with limiting shoulder 22 on drive shaft 21.

If output shaft 13 has been rotated to the safe position, by reapplying pressure to opposed lateral projections 29 away from pivot block 12, handle lock 25 may be lowered to approximately align with safe position axis 61. As this occurs, safe indexing walls 34 and 34' engage drive shaft 21 to again prevent rotation of output shaft 13. When handle lock 25 is aligned with safe position axis 61 pressure on opposed lateral projections 29 is released and helical compression spring 26 again urges handle lock 25 toward pivot block 12 until locking shoulder 24 engages safe locking shoulder socket 33, thereby locking the arming firing relock device in the safe position. Safe position axis 61 and armed position axis 71 are arranged approximately perpendicular to one another and approximately perpendicular to output axis 51 although exact angles are not necessary. When handle lock 25 is aligned approximately along output axis 51 the free position is defined where rotation of keyed member 13 or alternative output shaft 13' is enabled.

The device as described may be manufactured from any convenient engineering materials possessing the required strength depending upon other dimensions and specifications of the missile and arming firing device. The component parts of the arming firing relock device 11 could be manufactured for example by precision casting, and may advantageously be made out of stainless steel. Of course, any castable or machinable engineering material could be substituted.

Obviously many modifications and variations of the present invention are possible in light of the above teachings. It therefore is to be understood that within the scope of the appended claims the invention may be practiced otherwise than as specifically described.

What is claimed is:

1. An arming firing relock device comprising:

a pivot block having means for receiving a member in first and second positions;

an output shaft rotatably mounted to said pivot block;

a drive shaft pivotally attached to said output shaft; and a handle lock slidably retained on said drive shaft and resiliently biased toward said pivot block, said handle lock having means for lockingly engaging said means for receiving a member in said first and second positions.

2. An arming firing relock device as set forth in claim 1 wherein said handle lock has at least one lateral projection.

3. An arming firing relock device as set forth in claim 1 further including a spring pin pivotally joining said drive shaft and said output shaft.

4. An arming firing relock device as set forth in claim 3 wherein said drive shaft has a toroidal configuration at one end concentric with said spring pin.

5. An arming firing relock device as set forth in claim 1, further comprising:

a helical return spring encircling said drive shaft and bearing against said handle lock; and a spring stop rigidly attached to said drive shaft and bearing against said helical return spring.

6. An arming firing relock device as set forth in claim 5 wherein said spring stop defines a spline and said handle lock defines a longitudinal slot, said longitudinal slot slidably engaging said spline.

7. An arming firing relock device as set forth in claim 1 wherein said means for receiving comprises a safe engagement socket and an armed engagement socket for respective engagement with said handle lock in said first and second positions.

8. An arming firing relock device as set forth in claim 7 wherein said pivot block is configured to engage said drive shaft if said handle lock is engaging said safe engagement socket.

9. An arming firing relock device as set forth in claim 7 wherein said pivot block is configured to engage said drive shaft if said handle lock is engaging said armed engagement socket.

10. An arming firing relock device as set forth in claim 7 wherein said pivot block further defines a free position intermediate said safe engagement socket and said armed engagement socket, said handle lock and drive shaft being unrestrained in said free position and said output shaft being enabled to rotate.

11. An arming firing relock device as set forth in claim 7 wherein said safe engagement socket and said armed engagement socket are disposed on said pivot block relative to each other in a perpendicular relationship.

12. An arming firing relock device comprising:

a pivot block;

an output shaft rotatably mounted in said pivot block;

a drive shaft pivotally attached to said output shaft;

a handle lock slidably disposed upon said drive shaft;

a helical spring having first and second ends, said helical spring encircling said drive shaft and bearing against said handle lock on said first end; and a spring stop rigidly attached to said drive shaft and bearing against said second end of said helical spring.

13. An arming firing relock device as set forth in claim 12 wherein said spring stop defines a spline and said handle lock defines a longitudinal slot, said longitudinal slot slidably engaging said spline.

14. An arming firing relock device as set forth in claim 12 wherein said output shaft has a key lug on an end directed away from said drive shaft.

15. An arming firing relock device as forth in claim 12 wherein said handle lock defines a locking end and a gripping end, said locking end having a locking shoulder and said gripping end having at least one lateral projection.

16. An arming firing relock device as set forth in claim 15 wherein said output shaft is mounted in said pivot block for rotation about a first axis and said drive shaft is pivotally attached to said output shaft for pivoting motion about a second axis and wherein said first axis is perpendicular to said second axis.

17. An arming firing relock device as set forth in claim 16, further comprising:

said output shaft having two tines extending parallel with said first axis, and each of said tines defining a pivot hole, said pivot holes being aligned and coaxial with said second axis;

said drive shaft extending between said tines and defining a transverse hole coaxial with said second axis; and a spring pin resiliently retained within said transverse hole and extending pivotally into each of said pivot holes.

18. An arming firing relock device as set forth in claim 16 wherein said pivot block defines a safe engagement socket, an armed engagement socket and a free position, said locking shoulder engaging said safe engagement socket defining a safe position, said locking shoulder engaging said armed engagement socket defining an armed position, and said locking shoulder occupying said free position enabling rotation of said output shaft.

19. An arming firing relock device as set forth in claim 18 wherein said pivot block further defines a hole positioned coaxially with said second axis if said locking shoulder is engaging said safe engagement socket.

20. An arming firing relock device as set forth in claim 18 wherein said drive shaft defines a limiting shoulder positioned to limit motion of said locking shoulder toward said pivot block if said locking shoulder occupies said free position.

* * * * *